US006372058B1

(12) United States Patent
Ono

(10) Patent No.: US 6,372,058 B1
(45) Date of Patent: Apr. 16, 2002

(54) SEMI-TENSION MASK OF LOW-EXPANSION FE-NI ALLOY, AND COLOR PICTURE TUBE USING THE MASK

(75) Inventor: Toshiyuki Ono, Hitachi (JP)

(73) Assignee: Nippon Mining & Metals Co., Ltd., Tokyo (JP)

( * ) Notice: Subject to any disclaimer, the term of this patent is extended or adjusted under 35 U.S.C. 154(b) by 0 days.

(21) Appl. No.: 09/632,396

(22) Filed: Aug. 4, 2000

(30) Foreign Application Priority Data

Nov. 9, 1999 (JP) ..... 11-317899

(51) Int. Cl.[7] ..... C22C 38/08
(52) U.S. Cl. ..... 148/336; 420/94; 313/402
(58) Field of Search ..... 420/94; 148/336; 313/400

(56) References Cited

U.S. PATENT DOCUMENTS 5,628,841 A * 5/1997 Inoue et al. ..... 148/510

FOREIGN PATENT DOCUMENTS

JP 40-8193248 A * 7/1996
JP 40-9157800 A * 6/1997
JP 40-10330886 A * 12/1998

* cited by examiner

*Primary Examiner*—Deborah Yee
(74) *Attorney, Agent, or Firm*—Drinker Biddle & Reath LLP

(57) ABSTRACT

A low-expansion Fe—Ni based alloy for semi-tension masks with excellent creep properties consists of, in mass percentage, from 34 to 38% Ni, from 0.01 to 0.5% Mn, from 0.0003 to 0.0015% B, from 0.0010 to 0.0050% N, and the balance Fe and unavoidable impurities. The alloy further includes from 0.005 to 0.20% Si and from 0.005 to 0.030% Al. Among the unavoidable impurities, C, P and S are controlled to no more than 0.010%, no more than 0.015%, and no more than 0.010%, respectively. The alloy is subjected, at least once after hot rolling or after cold rolling, to annealing in a non-oxidizing atmosphere at between 650 and 750° C. for from 30 minutes to less than 5 hours. The alloy is subjected to stress relief annealing after final cold rolling. A semi-tension mask using the alloy and a color picture tube using the semi-stretched-tension mask, are also provided.

6 Claims, 1 Drawing Sheet

SEMI-TENSION MASK OF LOW-EXPANSION FE-NI ALLOY, AND COLOR PICTURE TUBE USING THE MASK

FIELD OF THE INVENTION

This invention relates to a semi-tension mask, also called a semi-stretched-tension (SST) mask which is formed of a Fe—Ni based alloy and is for use in a cathode ray tube (also called Braun tube). More particularly, this invention relates to such a Fe—Ni based alloy which is low in thermal expansion and yet has excellent creep properties, and which upon baking after subjection to tension for mask formation, is capable of suppressing mask wrinkling. The invention also relates to a semi-tension mask made of the alloy material, and further to a color picture tube using the semi-tension mask.

Masks for picture tubes are roughly divided into two types; (1) the shadow mask type in which a mask material is formed with electron-beam passing dots or slots by etching and then is pressformed to a mask form, and (2) the aperture grille type in which a mask material is formed with electron-beam passing vertical slits by etching and then is stretched, in two upward and downward directions and mounted onto a frame.

For the shadow mask type, Fe—36%Ni alloy (called "invar" alloy) is commonly used since this alloy has a very low coefficient of thermal expansion and can control the doming (expanding in a dome form) phenomenon that results from thermal expansion. For the aperture grille type whose structural features rarely generates doming phenomenon due to thermal expansion, soft steel that is higher in the coefficient of thermal expansion but is less costly is employed.

These two mask types have both merits and demerits and have been used respectively in the market. More recently, what is known as a semi-tension mask type has come on the stage as a new type combining the merits of the shadow mask and aperture grille mask types.

The semi-tension mask is made by providing mask material formed with electron-passing dots or slots by etching. The etched mask material is then supported on a frame while stretching (tensioning) in two upward and downward directions, as in the aperture grille type, rather than press-forming. At the beginning of development of this new type mask, the mask was stretched in four directions, namely leftward and rightward directions as well as upward and downward directions with a relatively strong force. But, when stretched in four directions with a relatively strong force, the mask often broke. In order to avoid such possible breakage of the mask, an improvement was tried, namely, to stretch the mask only in two upward and downward directions with a relatively weak force, attaining satisfactory results. A mask made by this improvement came to be called the "semi-stretched tension mask", or "semi-tension mask" for short in the sense that stretching with a relatively weak force in two directions only was adopted.

FIGS. 1(*a*) and (*b*) is an explanatory view schematically illustrating the semi-tension type mask and the aperture grille type mask, respectively. Both types of masks are stretched in upward and downward directions. In the semi-tension type mask, a number of vertical slot rows are formed over the mask breadth. Each slot row is composed of a number of slots with bridges left between adjacent slots. The aperture grille type mask includes a number of vertical long slits over the mask breadth. This necessitates damper wires for suppressing mask vibration caused by sound sources, such as speakers. The bridges in the semi-tension type mask are metal portions left unetched between the slots in each vertical slot row during etching. The bridges function to prevent torsion of the vertical slot rows. The semi-tension mask is also called the "bridged tension mask" due to the bridges present in each slot row.

Compared with the shadow mask type that depends on press forming, the new semi-tension type permits a flatter picture tube with greater brightness and higher resolution. Moreover, the semi-tension mask type is superior to the aperture grilled type in oscillation characteristics due to the presence of the bridges. Damper wires are not necessary. The semi-tension mask only requires relatively low loads for vertical stretching, making for cost reduction.

On the other hand, the semi-tension mask type is subject to doming upon thermal expansion, unlike the aperture grille type. To prevent this phenomenon, the use of Fe—Ni based alloys of low thermal expansion, centered around the invar allow, is under study. It has, however, been found that the use of conventional Fe—Ni based alloys including the invar alloy causes "tension down" or relaxation of tension in the mask upon heat treatment during the course of assembling, leading to major troubles such as wrinkling of the mask.

Thus, ordinary Fe—Ni alloys such as the invar alloy have not been found appropriate for semi-tension masks. Detailed investigation into the individual steps of mask manufacture has revealed that the inappropriateness of Fe—Ni alloys is attributable to the creep properties of the material.

In the course of manufacture, a mask material formed with dots or slots by etching is subjected to blackening treatment. Blackening treatment herein refers to a treatment for forming a black-colored film such as a film of iron oxide, on the surface of a mask material. The blackening treated mask material is welded to a frame and stretched under a predetermined load, and thereafter baked to eliminate strains that have resulted from welding and other operations. At the time of this baking, it has recently been found that the conventional Fe—Ni alloy material under frame tension undergoes plastic deformation at elevated temperature, or creeping. Once it occurs, creeping causes elongation of the mask accompanied with "tension down" or load relief. This in turn leads to mask wrinkling, deterioration of anti-oscillation characteristics, and various other problems. Although solid solution strengthening through addition of Cu, Nb, Mo, W, and Ta has been found useful in decreasing creep elongation, the addition of such elements inevitably increases the coefficient of thermal expansion of the resulting alloy.

BRIEF SUMMARY OF THE INVENTION

It has now been found that the addition of B, control of the N content, controlled addition of Al and Si, control of impurities C, P and S and heat treatment during the course of working, with strain relief annealing as desired, will markedly ameliorate the creep properties of the resulting alloy without adversely affecting its coefficient of thermal expansion, with no possibility of wrinkling or other defect in the steps of blackening-treating, stretching, and baking.

Based on this finding, the present invention solves the above problems by providing:

(1) a low thermal expansion Fe—Ni based alloy for semi-tension masks with excellent creep properties characterized by consisting of from 34 to 38% Ni, from 0.01 to 0.5% Mn, from 0.0003 to 0.0015% B, from 0.0010 to 0.0050% N, and the balance Fe and unavoidable impurities, (2) the Fe—Ni based alloy according to (1) which further includes from 0.005 to 0.20% Si and from 0.005 to 0.030% Al, (3) the Fe—Ni based alloy according to (1) or (2) wherein, among the unavoidable impurities, C is controlled to no more than 0.010%, P is controlled to no more than 0.015%, and S is controlled to no more than 0.010%, (4) the Fe—Ni based alloy according to (1), (2) or (3) which is subjected, at least once after hot rolling or cold rolling, to annealing in a non-oxidizing atmosphere at between 650° C. and 750° C. for from 30 minutes to less than 5 hours, and (5) the Fe—Ni based alloy according to (4) which is subjected to stress relief annealing after final cold rolling.

This invention further provides:

(6) a semi-tension mask using an Fe—Ni based alloy according to any of (1) to (5), wherein the mask member of said Fe—Ni based alloy is formed with dots or slots by etching followed by blackening treatment, and then is supported on a frame while stretching in upward and downward directions, and (7) a color picture tube using the semi-tension mask according to (6).

DETAILED DESCRIPTION OF THE INVENTION

Figure 1A:
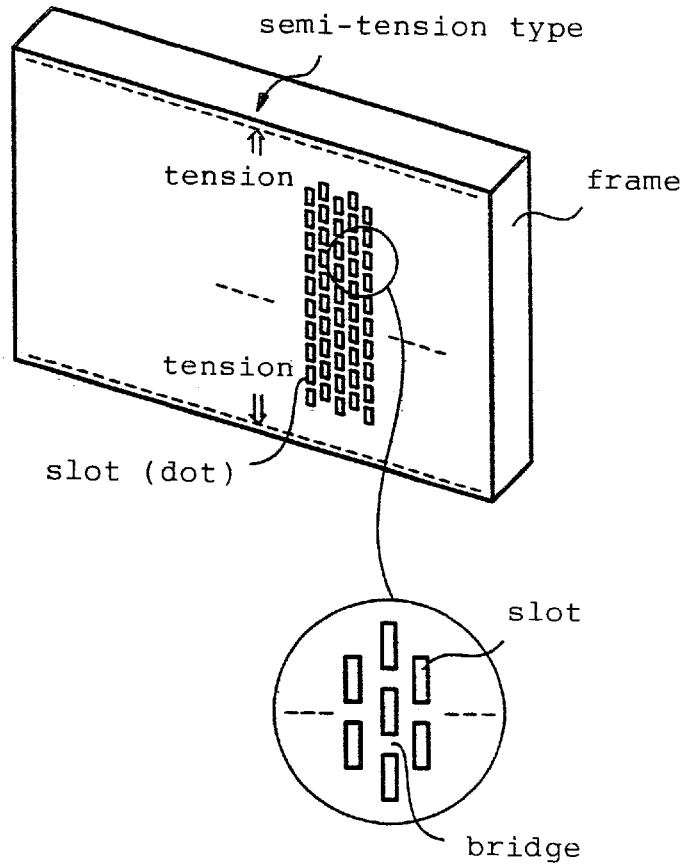
FIGS. 1(*a*) and (*b*) is an explanatory view schematically illustrating the SST type mask and the aperture grille type mask, respectively.
Figure 1B:
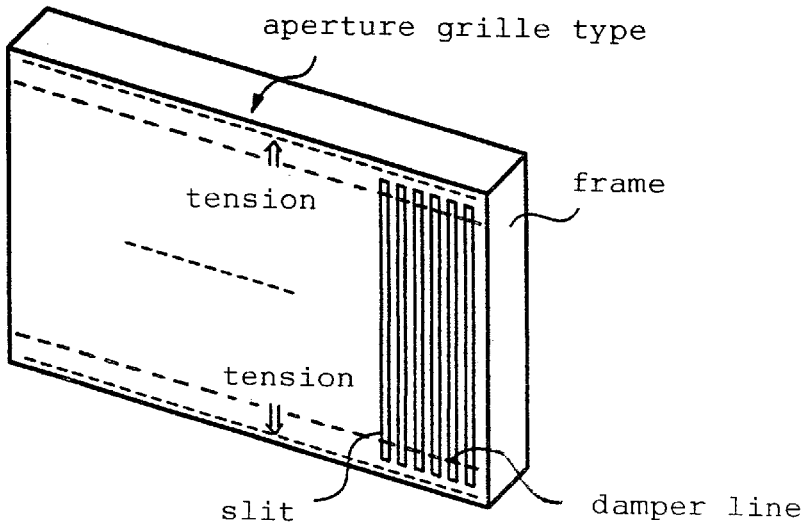

As explained before, FIG. 1(*a*) schematically shows a semi-tension type mask. The mask is stretched in upward and downward directions. In the semi-tension type mask, a number of vertical slot rows are formed over the mask breadth wherein each slot row is composed of a number of slots with bridges left between adjacent slots. The bridges in the semi-tension type mask are metal portions left unetched between the slots in each vertical slot row formed by etching. The bridges function to prevent torsion of the vertical slot row. Compared with the shadow mask type that depends on press forming, the semi-tension mask type permits a flatter picture tube with greater brightness and higher resolution. Moreover, the semi-tension mask type is superior to the aperture grille type in oscillation characteristics due to the presence of the bridges, with no need for damper wires. The semi-tension mask type requires only relatively low loads for vertical stretching, making for cost reduction.

In the basic manufacture process of a semi-tension mask, an Fe—Ni alloy ingot of a given composition is melted and prepared, for example, by vacuum melting. The ingot is then forged and hot rolled. After repeated cold rolling and annealing, the strip is subjected to final cold rolling to a sheet having a required final thickness. The annealing preceding the final cold rolling is called "final annealing". A mask material is formed with dots or slots by an etching technique (photoresist masking, developing, and spraying of an etching solution), and is subjected to blackening treatment. The blackening treatment is for forming a black-colored film, such as iron oxide film, on the surface of the mask material. The blackening treated mask material is welded to a frame while stretching under a predetermined load, and thereafter baked to eliminate strains that have resulted from welding and other operations.

As stated above, the mask material is stretched after blackening treatment. When the blackening temperature is much lower than the recrystallization temperature of the Fe—Ni based alloy, the work hardening of the alloy can be taken advantage of in improving the creep properties of the product. If the work hardening progresses to excess, the softening-starting temperature of the alloy is lowered, with a consequent increase in the rate of creep. Although it has been found possible to alleviate creep elongation by solid solution hardening with the addition of Cu, Nb, Mo, W, and Ta, depending upon the amounts of these additional elements, the coefficient of thermal expansion can sometimes increase, and the low expansion feature peculiar to the invar alloy is possibly impaired.

I have searched for elements that could be added to decrease the creep rate in proportions small enough not to adversely effect the thermal expansion of Fe—Ni based alloys. As a result, it has now been found that a trace addition of B and control of the N content causes fine-grain precipitation of boron nitride (BN) in the Fe—Ni alloy matrix. This improves creep properties with practically no increase in thermal expansion, nor objectionable effect upon the etchability of the alloy. This creep-improving effect is achieved as well when the mask member is blackeningtreated at a temperature which will initiate the softening of a Fe—Ni alloy containing no such trace element. For finer-grain precipitation of boron nitride, it is desirable to anneal the mask member, at least once after hot rolling or cold rolling, in a non-oxidizing atmosphere at between 650° C. and 750° C. for from 30 minutes to less than 5 hours. The annealing further enhances the creep properties.

The best effect that can be promised by blackeningtreament at elevated temperature is improvement in magnetic properties. For example, an invar alloy for a press-formed shadow mask, not containing trace additional elements, shows a relative magnetic permeability of 870 to 1000 upon blackening at 590° C. When the alloy is blackened at a 50° C. higher temperature, or 640° C., the relative permeability increases to 1030 to 1200. In a geomagnetic shield following AC demagnetization (as in a picture tube), the higher the relative magnetic permeability, the better the shield characteristics.

The material of a semi-tension mask is blackening-treated prior to stretching. The blackening treatment can cause distortion of the mask as the blackening-treatment relieves unevenness of residual stresses caused in the material at the time of etching to form dots or slots. To preclude this, it is advisable to conduct strain relief annealing after the final cold rolling.

Thus it has now been found that the addition of B, control of the N content, controlled addition of Al and Si, control of impurities C, P and S and heat treatment during the course of working, with strain relief annealing as desired, will markedly ameliorate the creep properties of the resulting alloy. This is achieved without adversely affecting the alloy coefficient of thermal expansion, with no possibility of wrinkling or other defects in the steps of blackening, stretching, and baking.

The grounds on which various limitations are placed under the invention will now be explained.

Ni:—If the Ni content is less than 34% or more than 38%, the thermal expansion coefficient of the alloy increases, unfavorably affecting the color purity. Hence the Ni proportion is specified between 34 and 38%.

Mn:—Mn is necessary because it makes S, an impurity that hampers hot workability, harmless. In a proportion below 0.01% it no longer achieves the favorable effect and, above 0.5%, it deteriorates the etching properties and raises the coefficient of thermal expansion. For these reasons the Mn proportion is limited to the range between 0.01 and 0.5%. A preferred range for the improvements of etching and thermal expansion properties is between 0.01 and 0.1%.

B:—B combines with N to form a nitride, which enhances creep properties. This effect is limited when B is less than 0.0003%, but a large B proportion roughens the etched surface, the tendency being pronounced with more than 0.0015% B. On these grounds the B proportion is specified to come between 0.0003 and 0.0015%.

N:—N is an element necessary to form a nitride with B. Below 0.0010%, it does not form enough nitride to improve the creep strength. Conversely, over 0.0050% N tends to form pores in the ingot. Therefore, the N range is from 0.0010 to 0.0050%.

Si:—Si is added as a deoxidant. Since a large Si content seriously affects etchability, the smaller the Si content, better. However, even in a small extent, Si is effective in improving creep properties. Hence the Si proportion is set between 0.005 and 0.20%. For better etching properties a range below 0.03% is preferred.

carry out heat treatment for a long period of time in a non-oxidizing atmosphere and below the dissociation temperature of boron nitride, at least once after hot rolling or cold rolling. Here, in order to precipitate boron nitride without increasing the crystal grain size, the heat treatment is done at between 650° C. and 750° C. with a time period of from 30 minutes to less than 5 hours. The treatment is carried out in a non-oxidizing atmosphere to avoid oxidation of B. When the treatment is to be conducted after hot rolling, it is preferably done after removal of the oxide scale that has resulted from the hot rolling.

Stress relief annealing:—Although it has no effect upon creep elongation of the mask after blackening-treatment, stress relief annealing is desirable since it controls uneven deformation due to release of the residual stresses at the time of blackening-treatment.

EXAMPLES

The invention will be more fully described in connection with examples thereof.

Table 1 lists alloy compositions used for the examples.

TABLE 1

| Comp. No. | C | Si | Mn | P | S | Ni | Al | B | N | Nb | Remarks |
|---|---|---|---|---|---|---|---|---|---|---|---|
| A | 0.003 | 0.01 | 0.27 | 0.004 | 0.003 | 36.1 | 0.018 | 0.0004 | 0.0028 | — | In con- |
| B | 0.004 | 0.01 | 0.26 | 0.003 | 0.003 | 35.8 | 0.021 | 0.0008 | 0.0018 | — | Formity |
| C | 0.006 | 0.02 | 0.26 | 0.003 | 0.002 | 36.0 | 0.008 | 0.0012 | 0.0022 | — | With |
| D | 0.003 | 0.01 | 0.27 | 0.003 | 0.002 | 36.2 | 0.015 | 0.0005 | 0.0027 | — | Claims |
| E | 0.003 | 0.02 | 0.25 | 0.004 | 0.003 | 36.0 | 0.022 | 0.0006 | 0.0041 | — | 1–3 |
| F | 0.013 | 0.03 | 0.26 | 0.003 | 0.003 | 36.2 | 0.012 | 0.0005 | 0.0015 | — | Conform- |
| G | 0.003 | 0.02 | 0.25 | 0.017 | 0.003 | 36.0 | 0.017 | 0.0006 | 0.0022 | — | Ing to |
| H | 0.004 | 0.03 | 0.27 | 0.002 | 0.012 | 35.7 | 0.011 | 0.0005 | 0.0020 | — | cl. 1–2 |
| I | 0.003 | 0.22 | 0.25 | 0.003 | 0.002 | 36.3 | 0.017 | 0.0006 | 0.0017 | — | In |
| J | 0.007 | 0.01 | 0.24 | 0.003 | 0.003 | 36.3 | 0.035 | 0.0005 | 0.0019 | — | conformity |
| K | 0.003 | 0.004 | 0.25 | 0.003 | 0.002 | 36.3 | 0.014 | 0.0004 | 0.0019 | — | with |
| L | 0.006 | 0.02 | 0.25 | 0.003 | 0.003 | 35.9 | 0.003 | 0.0005 | 0.0012 | — | Claim 1 |
| M | 0.004 | 0.02 | 0.28 | 0.004 | 0.003 | 36.2 | 0.012 | 0.0001 | 0.0021 | — | Not in |
| N | 0.003 | 0.03 | 0.26 | 0.004 | 0.003 | 35.9 | 0.015 | 0.0018 | 0.0005 | — | conformity |
| O | 0.004 | 0.04 | 0.26 | 0.002 | 0.003 | 36.2 | 0.014 | 0.0025 | 0.0053 | — | with claim 1 |
| P | 0.003 | 0.04 | 0.77 | 0.003 | 0.004 | 35.9 | 0.012 | 0.0004 | 0.0018 | — | |
| Q | 0.004 | 0.01 | 0.27 | 0.002 | 0.002 | 39.2 | 0.013 | 0.0005 | 0.0021 | — | |
| R | 0.004 | 0.01 | 0.007 | 0.002 | 0.003 | 36.1 | 0.012 | 0.0004 | 0.0018 | — | |
| S | 0.003 | 0.02 | 0.26 | 0.001 | 0.004 | 33.3 | 0.012 | 0.0006 | 0.0016 | — | |
| T | 0.004 | 0.01 | 0.24 | 0.003 | 0.003 | 35.9 | 0.014 | 0.0005 | 0.0021 | 0.3 | |

Al:—Al is used as a deoxidant. A solid solution with much Al proves effective in improving creep properties. However, too much Al forms alumina. Alumina impairs etchability and also produces alumina-derived surface flaws on cold rolling. The range, therefore, is between 0.005 and 0.030%.

C:—C forms carbides. More than 0.010% C forms carbide to excess, impairing etchability. For this reason 0.010% is the upper limit. C in solid solution state too affects etchability adversely. Hence the smaller the C content the better. A preferred C proportion is below 0.005%.

P:—Excessive P causes poor etching. The P content, therefore, should be kept below 0.015%.

S:—S in excess of 0.010% has a detrimental effect upon hot workability, while forming much sulfide inclusions which, in turn, impairs etchability. Hence, its upper limit is set to 0.010%.

Conditions of heat treatment during working:—To cause fine-grain precipitation of boron nitride, it is desirable to The Fe—Ni alloys of the compositions given in Table 1 were melted and prepared by vacuum melting. A nitrogen atmosphere was used in the stage where B (boron) and other alloying elements were added. The melting method is not limited to vacuum melting; other refining process using a vessel instead of a furnace, such as a VOD process, may be adopted instead. In the latter case, the nitrogen content can be controlled by mixing nitrogen into argon gas for bubbling use during refining. As a further alternative, iron nitride may be employed as the starting material. In the melting process, the oxygen level in molten steel must be low enough since boron nitride (BN) becomes boron oxide above 1000° C., and it is desirable that the oxygen concentration after the addition of boron should be no more than 100 ppm. In the working examples each ingot so obtained was forged and hot rolled to a thickness of 3 mm, cold rolled and annealed repeatedly to a sheet 0.15 mm thick. The work was heat treated in an Ar atmosphere at 680° C. for 2 hours after hot rolling, or as one of the annealing runs between repeated cold rolling operations. The remainder of annealing runs during the course of cold rolling were done as bright annealing.

The sheets thus obtained were annealed for recrystallization and were further cold rolled to a thickness of 0.1 mm. They were then treated at 640° C. for 15 minutes for blackening. Following the treatment, the sheets were heated to 460° C. and subjected to a tensile stress of 200 N/mm$^2$. Creep elongation values were determined 30 minutes later. The tensile direction was parallel to the rolling direction.

The average thermal expansion coefficients of the specimens between 30° C. and 100° C. were determined, and a 45 Be aqueous solution of ferric chloride at 60° C. was sprayed at a pressure of 0.3 MPa over the surfaces of specimens and the etched surface conditions were inspected.

Table 2 shows creep elongation values, thermal expansion coefficients, and also etched surface conditions as a measure of etchability of the specimens tested.

As Nos. 2, 3, 7, and 9 show, the annealing in Ar at 680° C. for 2 hours after hot rolling or cold rolling reduced creep elongation. This was attributed to finer precipitation of boron nitride.

Nos. 10 to 12 contained less than 0.0003% B. With the B contents below the range specified in claim 1 (B:0.0003 to 0.0015%), the specimens lacked the boron nitride effective for reducing creep elongation, the elongation percentage being far more than 0.16% presumed to be the lower limit above which wrinkling of the mask could occur. The specimens of Nos. 11 and 12 were annealed in Ar at 680° C. for 2 hours after hot rolling or cold rolling so as to achieve finer precipitation of boron nitride. Nevertheless, the insufficiency of B kept them from attaining the improvements in creep elongation as observed with Nos. 2, 3, 7, and 9.

No. 13 contained less than 0.0010% N. Since the B content was below the range specified in claim 1 (N: 0.0010% to 0.0050%), the specimen was short of the boron nitride effective for reducing creep elongation, and its elongation percentage was far more than the 0.16% presumed to be the lower limit above which an SST mask would wrinkle. No. 13 contained more than 0.0015% B and the etched surface was too rough to be used as an SST mask material. This was especially true of No. 14 in which both the B and N content exceeded the ranges of the present invention.

TABLE 2

| No. | Comp. No. | Annealing in Ar at 680° C. for 2 hrs | Creep elongation (%) after blackening at 640° C. for 15 min and tensioning with 200 N/mm$^2$ at 460° C. | Average thermal expansion coeff at 30–100° C. × $10^{-7}$/° C. | Etched surface condition |
|---|---|---|---|---|---|
| 1 | A | No | 0.126 | 11 | Good |
| 2 | A | After hot r. | 0.122 | 11 | " |
| 3 | A | Between cold r. | 0.115 | 12 | " |
| 4 | B | No | 0.120 | 11 | " |
| 5 | C | No | 0.118 | 13 | " |
| 6 | D | No | 0.108 | 12 | " |
| 7 | D | Between cold r. | 0.103 | 12 | " |
| 8 | E | No | 0.125 | 12 | " |
| 9 | E | After hot r. | 0.121 | 12 | " |
| 10 | M | No | 0.274 | 12 | Good |
| 11 | M | After hot r. | 0.273 | 11 | " |
| 12 | M | Between cold r. | 0.276 | 11 | " |
| 13 | N | No | 0.165 | 14 | Fair* |
| 14 | O | " | 0.112 | 15 | " |
| 15 | I | " | 0.119 | 16 | " |
| 16 | J | " | 0.124 | 14 | " |
| 17 | P | " | 0.148 | 21 | " |
| 18 | Q | " | 0.140 | 34 | Good |
| 19 | K | " | 0.156 | 12 | " |
| 20 | L | " | 0.153 | 11 | " |
| 21 | R | " | 0.119 | 9 | Fair* |
| 22 | S | " | 0.128 | 37 | Good |
| 23 | F | " | 0.127 | 12 | Fair* |
| 24 | G | " | 0.124 | 14 | " |
| 25 | H | " | 0.142 | 13 | " |
| 26 | T | " | 0.121 | 18 | Good |

*Minute irregularities and etched marks with impurities.

Nos. 1 to 9 represent examples of the invention meeting all the requirements of claims 1 to 3 (all compositional requirements as to Ni, Mn, B, N and Si, Al and C, P, S). Nos. 2, 3, 7, and 9 were subjected to the intermediate heat treatment defined in claim 4 (BN precipitating annealing).

With actually blackened SST masks, the materials that wrinkled and not wrinkled after baking were blackened and tested for their creep properties under the same conditions as used in the above examples. The creep elongation percentage that forms the border between wrinkling and no wrinkling was found to be 0.16%. Specimens of Nos. 1 to 9 indicated creep elongation values of less than 0.16%. Their coefficients of thermal expansion were below $13\times10^{-7}$/° C., or approximately the same as the coefficients of the B-free specimens of Nos. 10 to 12 (with a chemical composition M) and less than about 70% of No. 26 (chemical composition T) that contained 0.3% Nb.

Nos. 15 to 17 gave creep elongation percentages of less than 0.16% after blackening treatment at 640° C. However, the presence of many impurities (as inclusions, $SiO_2$ in No. 15, $Al_2O_3$ in No. 16, and MnS in No. 17) results in etching traces upon etching which roughens the etched surface. These materials are not deemed satisfactory as such for SST masks. Above all, $Al_2O_3$ occurs in clusters and MnS is elongated in a linear pattern because of its ductility. These inclusions mar the edge contours of dot or slot etched apertures. No. 17, with more than 0.50% Mn, has an excessively high coefficient of thermal expansion.

Nos. 18 and 22, with Ni contents outside the range specified in claim 1 (Ni: 34% to 38%), have such high thermal expansion coefficients that, from the doming standpoint, they are not suitable as materials for semi-tension masks.

No. 19 that contained less than 0.005% Si indicated a creep elongation value after blackening treatment close to 0.16%, the elongation percentage presumed to be the lower limit above which wrinkling of the mask could occur. Compared with Nos. 1 to 9, the alloy can present a problem in respect of creep elongation when it is subjected to a blackening temperature in excess of 640° C. The same is true of No. 20 that contained less than 0.005% Al.

No. 21 showed creep elongation below 0.16% and a low coefficient of thermal expansion. However, with less than 0.01% Mn, the alloy could sometimes fail to prevent embrittlement with S segregation during hot working. The alloy could develop cracks or spills (peeling flaw) on forging or hot rolling. Etching forms substantial indented irregularities along the grain boundaries of the alloy, presumably due to segregation of S in the boundaries.

No. 23 contained more C, No. 24 more P, and No. 25 more S, than the ranges specified in claim 3 (C, P and S: no more than 0.010%, no more than 0.015%, and no more than 0.010%, respectively). These alloys showed creep elongation values of less than 0.16% after blackening. However, they are not suitable as mask materials because many impurities in the materials (iron carbide in No. 23, phosphorus segregation in No. 24, and MnS in No. 25) form traces on etching and roughen the etched surface. In particular, segregated MnS and phosphorus is ductile and is elongated in linear form, adversely affecting the edge contours of etched dot or slot apertures.

Lastly, No. 26 containing 0.3% Nb had limited creep elongation but had a high thermal expansion coefficient compared with Nos. 1 to 9. Where weight is placed on the doming phenomenon due to thermal expansion, therefore, it is necessary to apply a sufficiently high stretching force to prevent the deterioration of doming properties by thermal expansion of the mask. For this reason the frame strength of the mask must be increased at extra cost.

In the above working examples of the invention, final cold rolling was not followed by stress relief annealing. It was confirmed, however, that a test specimen prepared under conditions identical to No. 1 and annealed for one second at 750° C. for stress relief exhibited creep elongation of 0.127% after blackening. The stress relief had no adverse influence on creep elongation. It should be noted, however, that when stress relief annealing is not done after final cold rolling, the residual stress distribution in mask material formed with etched dots or slots is sometimes out of balance. The unbalanced stresses released by blackening treatment can deteriorate the shape of the mask. Thus, from the viewpoint of the stretching operation, stress relieving is desirable, so that blackening treatment does not impair the mask configuration. Where necessary, correction of the shape by a tension leveler or other means may be performed. It is to be understood, of course, that the addition of such a process step does not affect the validity of this invention, but falls within the purview of the invention as set forth in the appended claims.

The Fe—Ni alloy according to this invention, with both excellent creep properties and thermal expansion comparable to invar alloy, is a suitable material for color picture tubes free of color impurity or other trouble. Improvements in creep properties comparable to those achieved by the addition of solid-solution strengthening elements can be achieved with practically little increase in thermal expansion coefficient.

The semi-tension mask according to this invention desirably permits flattening of the screen of a color picture tube.

What is claimed is:

1. A semi-tension mask comprising as a mask material an Fe—Ni based alloy consisting of, in mass percentage, from 34 to 38% Ni, from 0.01 to 0.5% Mn, from 0.0003 to 0.0015% B, from 0.0010 to 0.0050% N, the balance of said alloy being Fe and unavoidable impurities, wherein the mask has been formed by etching dots or slots in the mask material, carrying out blackening treatment on the etched mask material, and supporting the etched and blackening-treated mask material on a frame while stretching in upward and downward directions to form said semi-tension mask.

2. A semi-tension mask comprising as a mask material an Fe—Ni based alloy consisting of, in mass percentage, from 34 to 38% Ni, from 0.01 to 0.5% Mn, from 0.0003 to 0.0015% B, from 0.0010 to 0.0050% N, from 0.005 to 0.20% Si, and from 0.005 to 0.030% Al, the balance of said alloy being Fe and unavoidable impurities, wherein the mask has been formed by etching dots or slots in the mask material, and supporting the etched and blackening-treated mask material on a frame while stretching in upward and downward directions to form said semi-tension mask.

3. A semi-tension mask according to claim 1 or 2 wherein, among the unavoidable impurities, C is controlled to no more than 0.010%, P is controlled to nor more than 0.015%, and S is controlled to no more than 0.010%.

4. A semi-tension mask according to claim 1 or 2 wherein the mask material prior to etching has been subjected to hot rolling or cold rolling, and after such rolling, has been annealed in a non-oxidizing atmosphere at between 650° C. and 750° C. for from 30 minutes to less than 5 hours.

5. A semi-tension mask according to claim 4 wherein the mask material has been subjected to stress relief annealing after a final cold rolling.

6. A color picture tube comprising a semi-tension mask according to claim 1 or 2.

* * * * *